US006467198B1

(12) United States Patent
James

(10) Patent No.: US 6,467,198 B1
(45) Date of Patent: Oct. 22, 2002

(54) HIGH FLEX GRINDING SHOE

(75) Inventor: Brent James, Manhattan Beach, CA (US)

(73) Assignee: Artemis Licensing Inc., Santa Ana, CA (US)

( * ) Notice: Subject to any disclaimer, the term of this patent is extended or adjusted under 35 U.S.C. 154(b) by 125 days.

(21) Appl. No.: 09/737,134

(22) Filed: Dec. 13, 2000

(51) Int. Cl.[7] ..... A43B 5/16
(52) U.S. Cl. ..... 36/115; 36/31; 36/72 A
(58) Field of Search ..... 36/115, 31, 72 A, 36/108, 107, 23, 24, 15

(56) References Cited

U.S. PATENT DOCUMENTS 5,970,631 A 10/1999 Inman
6,006,450 A 12/1999 Hayes
6,041,525 A 3/2000 Kelley
6,115,946 A 9/2000 Morris et al.

FOREIGN PATENT DOCUMENTS

WO PCT/US97/11652 7/1997

*Primary Examiner*—Mickey Yu
*Assistant Examiner*—Troy Arnold
(74) *Attorney, Agent, or Firm*—Fulwider Patton Lee & Utecht, LLP

(57) ABSTRACT

Quick release grinding shoe device formed in its arch region with a fastener passage and a downwardly extending first locking element for complemental receipt of a quick release grinding plate formed its front extremity with a longitudinally projecting fastener to be received in the fastener passage, a second locking element to slidably pass through the first locking element, and a rotatable washer included in the second locking element to lock the grind plate to the arch region of the grinding shoe.

27 Claims, 4 Drawing Sheets

FIG. 2
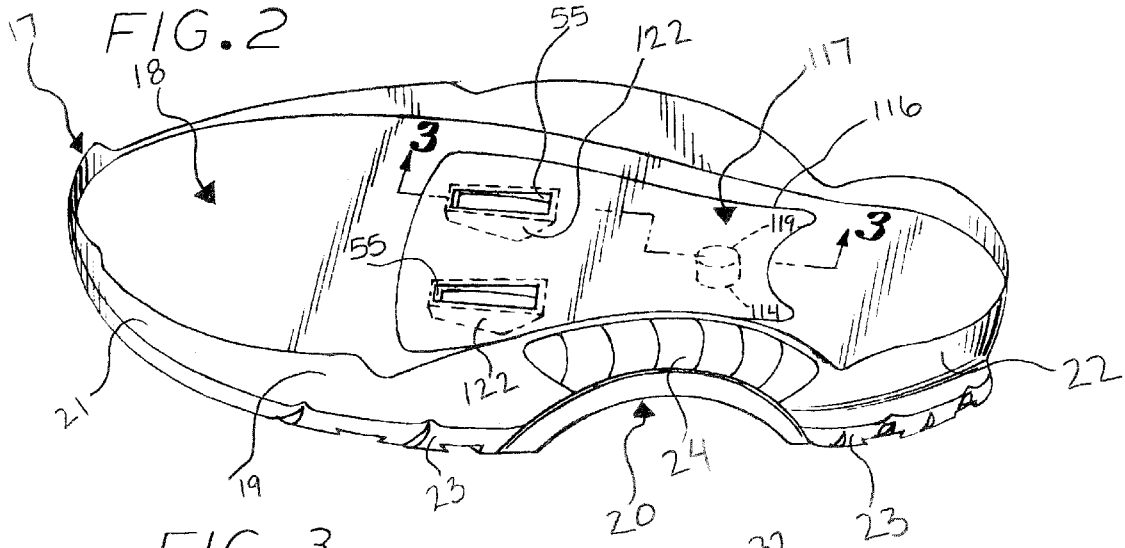
FIG. 3
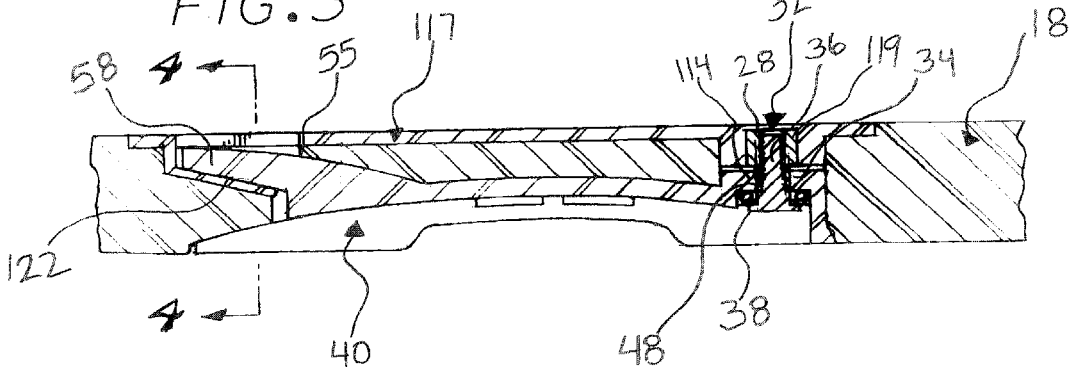
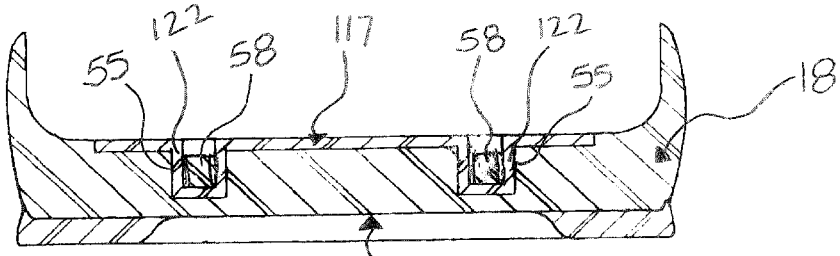
FIG. 4

3/4
FIG. 5
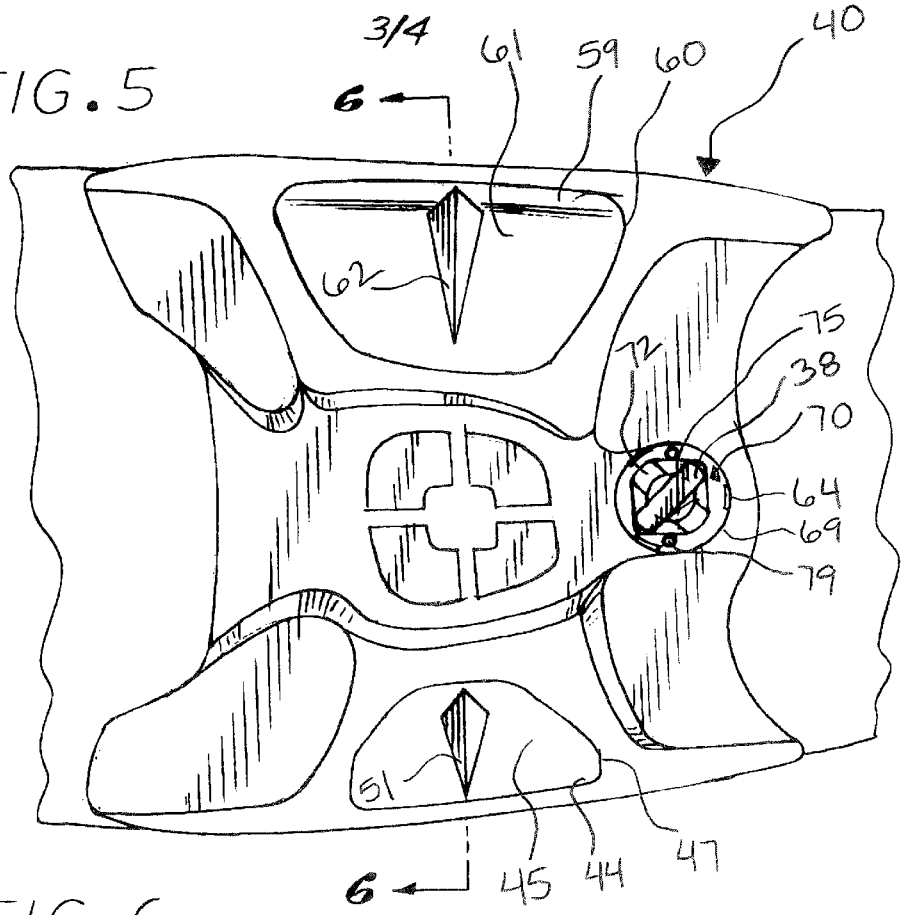
FIG. 6
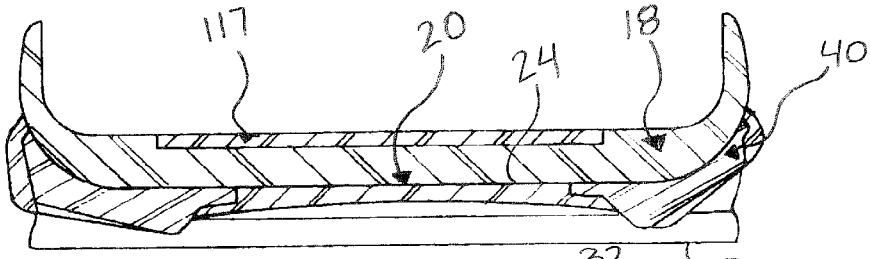
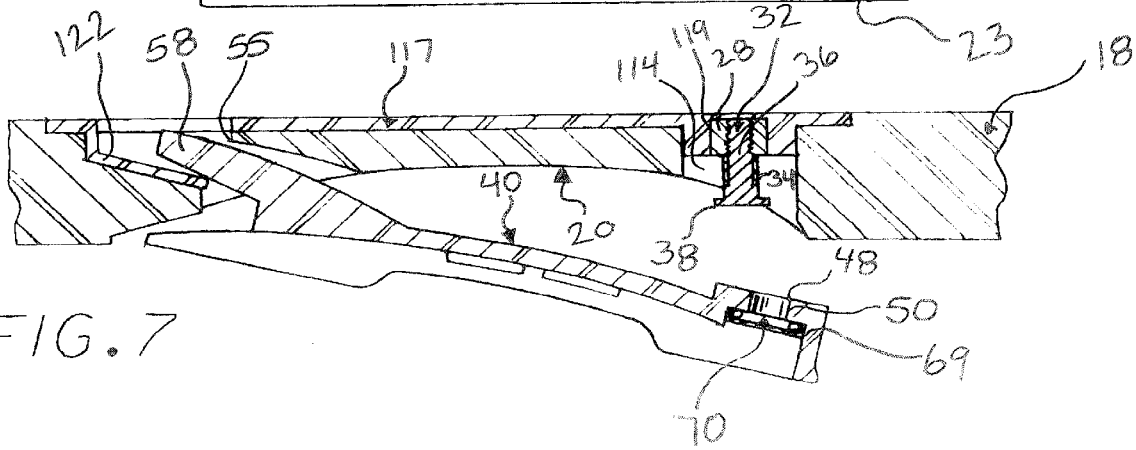
FIG. 7

FIG. 8
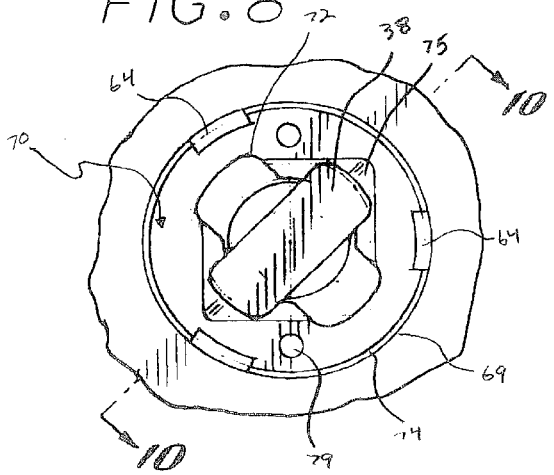
FIG. 9
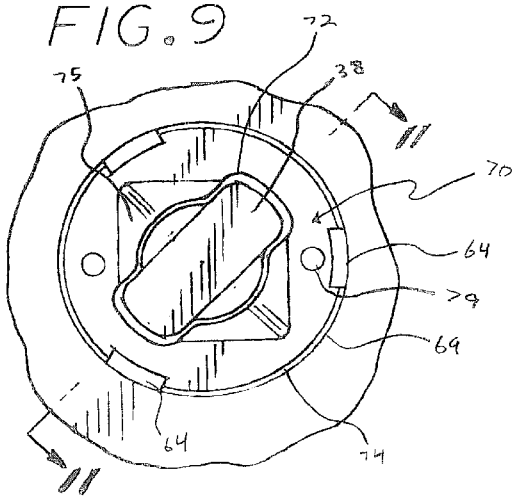
FIG. 10
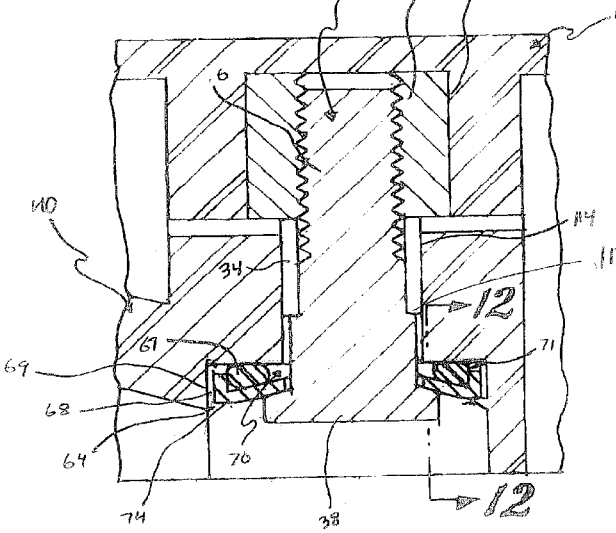
FIG. 11
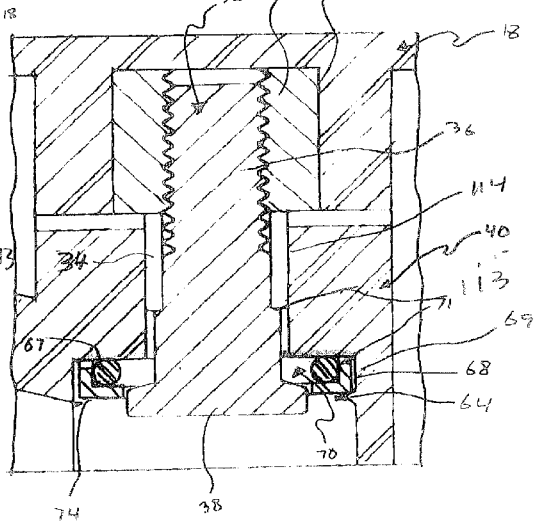
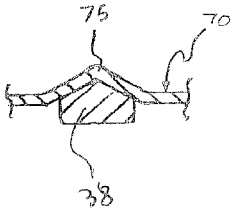
FIG. 12

HIGH FLEX GRINDING SHOE

BACKGROUND OF THE INVENTION

1. Field of the Invention

The present invention relates to articles of athletic footwear, and more particularly to grinding shoe devices utilized for sliding along, for instance, a pipe, a rail, an edged surface or the like.

2. Description of the Prior Art

In recent years, the popularity of "extreme sports" such as skateboarding and rollerblading has increased significantly. As athletes push the envelope, attempting to perform more impressive maneuvers in increasingly more difficult locations, they demand more specialized and better performing equipment and footwear. This demand has inspired rapid advancement and broadened capabilities in the footwear used by these athletes.

For example, athletes first discovered that the configuration of the skateboard also allowed skaters to slide sideways across a protruding feature on a supporting surface, such as an edge, a ridge, a curb, a handrail, a pipe or the like, by engaging the underside of the board with, for instance, a rail and then sliding laterally or longitudinally along the rail. Popularly referred to as "grinding," this is an exciting acrobatic maneuver that greatly increases the enjoyment of skateboarding by expanding the options available in using skateboards.

As in-line skating, or rollerblading, gained in popularity, in-line skate shoes carried on aligned wheels become common place. Soon athletes began performing in-line skating maneuvers where a user could jump up into the air and slide the undercarriage of his or her skate shoes sideways along a rail or the like, expanding the scope of the equipment used in grinding to include in-line skates. Recently, in-line skates, such as those disclosed in U.S. Pat. No. 5,967,552 (Roderick et al.), have been adapted to incorporate inwardly curving arched portions into the wheel frame designed to allow skating and more controlled grinding by the wearer.

A marked departure from conventional in-line skate shoes led to the development of an entirely new industry—grind shoes. As the popularity of grinding increased, many athletes became frustrated with the burden of carrying the requisite grinding gear with them during their activities. Therefore, grind shoes were first introduced to the marketplace by the assignee of the rights in the instant invention under the trademark SOAP®. The first such shoes incorporated a saddle shaped grind plate mounted in a recess in the arch of a shoe sole as depicted in U.S. Pat. No. 5,970,631 (Inman) assigned to the assignee of the instant application. This patent generally described an athletic shoe incorporating a grind plate for performing similar and novel sliding maneuvers to those performed by skateboarders and in-line skaters over rigid support surfaces commonly found in outdoor settings such as parking lots and walkways, as well as obstacles provided in manmade skate parks. The grind shoe and its associated grind plates have been well received in the marketplace and have led to major commercial success.

As the grinding sport developed, greater demand has been put on the shoe equipment. Athletes seek to carry out extreme maneuvers involving sliding of the grind plates along a rail. Oftentimes, the athlete elects to grind on special equipment such as inclined grind rails. The dynamics of certain maneuvers and the material composition of certain grinding surfaces, coupled with the characteristics of the leg and foot anatomy and the level of expertise in the athlete, is such that some of the more extreme maneuvers can be best achieved by specifically adapted grinding shoes or plates. For example, U.S. Pat. No. 6,006,450, also assigned to the assignee of the instant application, incorporates a wear resistant brake tab secured between the upper mid-sole and the plate and having an abrasive surface to enable the grinder to roll over the shoe and contact the rail to slow down the speed of the slide.

With the popularity of the grinding activities, users have demanded greater comfort in grind shoes which may be worn throughout the day during regular daily activity. Thus, there existed a demand for grind shoes which are lightweight and relatively flexible in the sole area to thus add to comfort and to provide for flexibility during the walking gait to minimize the somewhat "Frankenstein" maneuver often associated with rigid sole snow ski boots. It is also desirable that the grind plates be removable from the shoe sole for ready replacement in the event of wear or in the event the athlete seeks high performance grinding characteristics on different support surfaces having different degrees of roughness and coefficients of friction. To this end, commercially available grind shoes have typically incorporated mounting hardware in the form of threaded inserts embedded in the shoe sole for mounting metal fastener studs which might receive mounting forks formed in prongs incorporated in the respective grinding plates. The metal screws and mounting studs are often relatively heavy thus adding to the weight of the shoe and detracting from its performance. Furthermore, any freedom of movement between the shoe sole and grind plate provided by elongated slots in the grind plate fitted about the mounting screws is typically restricted by the inexact tolerances between the mating parts and the overall coefficient of friction afforded by the general coupling arrangement. Consequently, there exists a need for a grind shoe apparatus which is lightweight and provides for ready freedom of movement between one end of the grind plate and the shoe sole to thus maintain high flexibility in the shoe sole and minimize any rigidisation from coupling with the grind plate.

There also exists a need for a grind plate coupling mechanism which is convenient to uncouple and recouple and which can be operated in a relatively rapid fashion to thus minimize the time taken for an exchange of plates during any grinding contest or exercise undertaken by the user.

SUMMARY OF THE INVENTION

The grinding shoe apparatus of the present invention includes a sole characterized by an underside formed in the arch area with a downwardly opening cavity with a predetermined configuration and grind plate complementally received therein. The sole is configured with a slide fastener passage at one end of the cavity and a first locking device mounted at the opposite end. The grind plate includes a slide fastener at one end to be floatably received in sliding relationship in the fastener passage of the sole, and a second locking device at the opposite end to anchor to the first locking device. In the preferred embodiment, such first and second fasteners cooperate to form a quick release for rapid decoupling and recoupling.

Other objects and features of the invention will become apparent from consideration of the following description taken in conjunction with the accompanying drawing.

BRIEF DESCRIPTION OF THE DRAWINGS

FIG. 2 is a top perspective view of the shoe apparatus depicted in FIG. 1 in its assembled state;

FIG. 3 is a longitudinal sectional view, in enlarged scale, taken along the line 3—3 of FIG. 2;

FIG. 4 is a vertical transverse sectional view taken along the line 4—4 of FIG. 3;

FIG. 5 is a partial bottom plan view, in enlarged scale, of the shoe apparatus shown in FIG. 1;

FIG. 6 is a vertical transverse sectional view taken along the line 6—6 of FIG. 5;

FIG. 7 is a longitudinal sectional view similar to FIG. 3 but depicting the grind plate being removed from the shoe;

FIG. 8 is a partial bottom plan view, in enlarged scale, of the lock assembly shown in FIG. 5;

FIG. 9 is a partial bottom plan view similar to FIG. 8 but depicting the lock assembly in its unlocked position;

FIG. 10 is a vertical sectional view taken along the line 10—10 of FIG. 8;

FIG. 11 is a vertical sectional view taken along the line 11—11 of FIG. 9; and FIG. 12 is a vertical sectional view taken along the line 12—12 of FIG. 10.

DETAILED DESCRIPTION OF THE PREFERRED EMBODIMENTS

Figure 1:
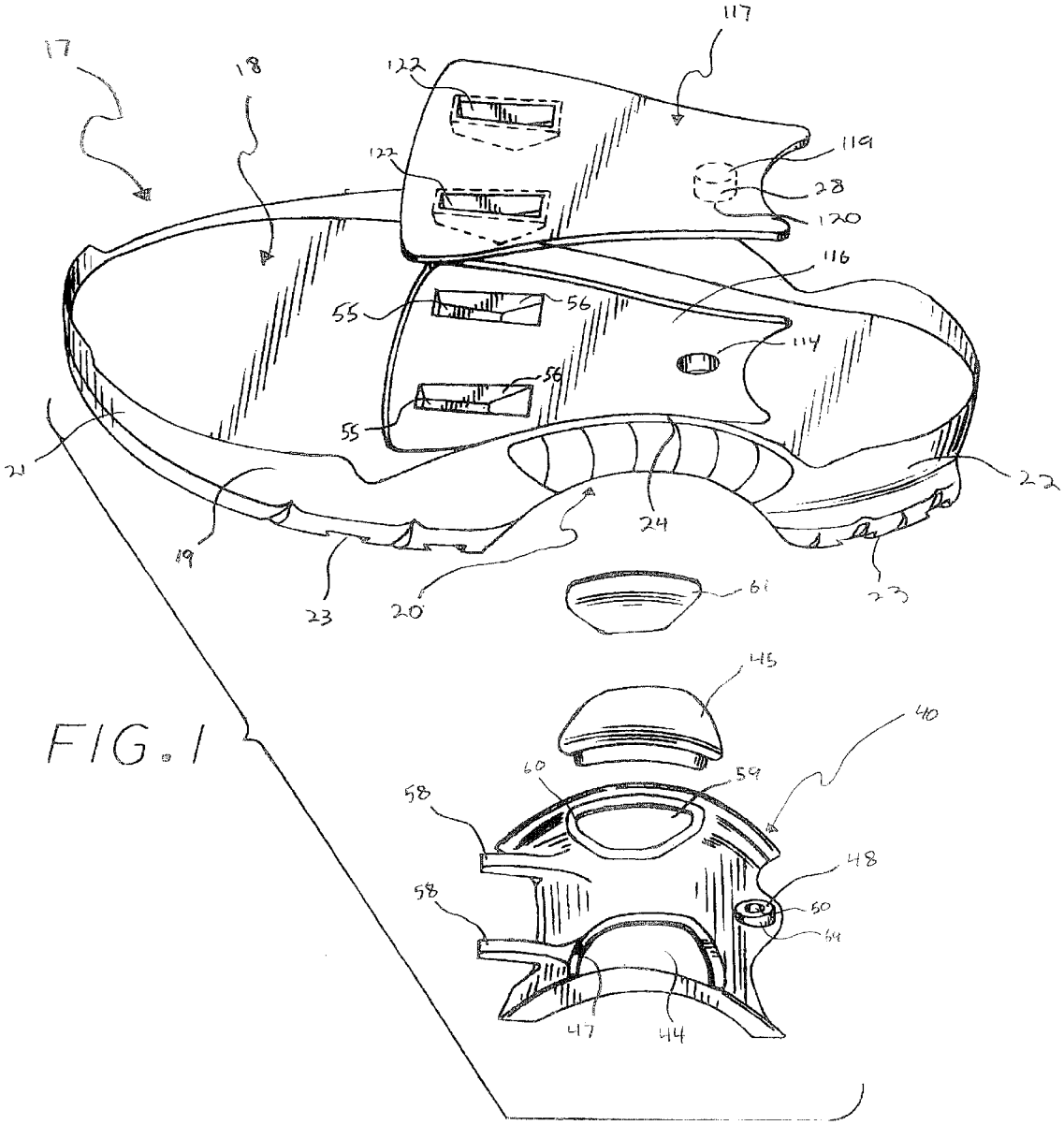
FIG. 1 is an exploded top perspective view of a grind shoe apparatus embodying the present invention.

As shown in the drawings and for purposes of illustration, the present invention is embodied in a grinding shoe apparatus, generally designated 17, (FIG. 1) intended for sliding along elongated support surfaces such as rails, curb edges, and the like. While the figures are generally directed to a right shoe, it will be appreciated that these principles apply equally to the left shoe as well. The grinding shoe apparatus 17 includes, generally, a shoe sole 18 formed on its bottom with a downwardly opening cavity 20 for removably receiving a grind plate, generally designated 40. A mounting plate 117 generally spanning the length of the cavity 20 is affixed to the top side of the sole 18 to assist in securing the grind plate 40 to the sole.

With further reference to FIGS. 1 and 2, the sole 18 is attached to a conventional upper (not shown) by methods well known to those of ordinary skill in the art, and consists of an parametrical stub sole 19 including a spaced apart forefoot section 21 and a heel section 22 each terminating in a downwardly facing high friction tread surface 23. Interposed between the forefoot and heel sections substantially within the arch area 24 of the shoe, is an upwardly recessed wall forming the downwardly opening cavity 20 in the parametrical insole wall 19. The cavity 20 is generally pre-formed during the molding process of the sole with a preferable depth greater than the height of the grind plate 40 such that installation of the plate positions its lowermost extremity above a horizontal plane passing through the tread surface 23. Consequently, the installed grind plate 40 will not interfere with normal shoe functions such as walking and running. The cavity 20 spans the entire width of the sole 18 and also projects longitudinally within the arch area 24. Portions of the cavity 20 project upwardly along the lateral and medial sides of the shoe 17 to receive portions of the grind plate 40, which wrap up onto the sides of the sole 18. Referring now to FIG. 6, the cavity 20 is generally arcuately shaped when viewed in longitudinal cross section. Other cavity shapes will also be apparent to those of ordinary skill in the art and will not detract from the present invention.

The sole 18 is generally formed of an elastomeric material and/or from a urethane-based substance commonly used in the industry. It is to be appreciated that other materials well known in the industry may also be used. However, it is preferable to use materials that will hold up under prolonged usage and provide some cushioning.

With continued reference to FIG. 1, the sole 18 of the present invention is formed in the front portion of the cavity 20 with a pair of laterally spaced apart, upwardly and forwardly projecting clearance slots 55 which open upwardly into the top surface of the sole and may be lined with a hard liner 56 composed of a suitable material to form respective downwardly and rearwardly opening slide scoops 112. The sole is formed in the rear portion of the cavity with a through bore 114 to facilitate releasable mounting of the plate 40. The top side of the sole is formed with a contoured recess 116 for complementally receiving a mounting plate, generally designated 117. The mounting plate 117 is configured to complement the shape of the arch of the foot, and is configured in the forward portion of the arch with a pair of laterally spaced, downwardly projecting, rearwardly opening slides defining the scoops 122 to be complementally received downwardly into the respective through slots 55. These scoops are somewhat boxed shaped in transverse cross section and may be open on their top sides. The internal transverse cross section of such scoops is ample to provide for loose fit therein of the respective tines 58 for free sliding of such tines with minimal frictional resistance. It will be noted that the bottom walls of such scoops angle downwardly and rearwardly to complement the downward and rearward slope of the bottom surfaces of the respective tines 58 such that downward and rearward sliding of such tines is facilitated to essentially allow the forward end of such grind plate to essentially pivot downwardly and rearwardly relative to the rear extremity of such grind plate. In the preferred embodiment, the side walls of the scoops 122 angle forwardly and inwardly to form a somewhat wedge shaped slide opening. It will also be appreciated that the grind plate is relatively lightweight and is complemented by the scoops 122 being relatively lightweight plastic to afford an overall lightweight shoe.

The mounting plate 117 is further formed in its rear portion with a downwardly depending cylindrical barrel 119 to nest down in the sole bore 114 and itself formed centrally with a downwardly opening barrel bore 120. Press fit into such bore is an internally threaded insert 28.

Referring now to FIGS. 3 and 7, the stem 36 of an inverted T-screw 32 is screwed into such insert 28 and includes on its lower extremity a laterally projecting keeper pin 38. In a preferred embodiment, the T-screw 32 is passed down into the bore 114. The T-screw is further formed with an upwardly facing shoulder 113 and receives telescopically thereover a spacer sleeve 34 interposed between such shoulder and the bottom end of the insert 28.

Referring now to FIGS. 1 and 5, the grind plate 40 of the present invention is typically injection molded from a rigid molded plastic such as Nylon 6 plastic or TPU, selected for its resistance to wear while providing a relatively high coefficient of friction when compared to the typical grinding surfaces, and, as shown in FIG. 6, is constructed with an arcuate top surface to complementally abut the cavity wall 20 so that the plate rests directly against the cavity wall. The tines 58 project forwardly from the front end of such plate and are tapered to form a wedge shape complementing the wedge shape of the scoops 122. Such tines are substantially smaller in transverse and vertical cross section to thus provide for a gap of about 1/16 of an inch between the top thereof and the insole of the shoe (not shown) and a gap of about 1/64 of an inch between either side thereof and the corresponding vertical walls of the scoops 122.

With continued reference to FIGS. 1 and 5, the grind plate 40 is in the form of a transversely extending saddle shape and is turned upwardly on its opposite sides to complementally grasp the opposite sides of the sole 18 in the arch area, and complementally abut the cavity wall 20 so that the grind plate rests directly against the cavity wall. Referring to FIGS. 5 and 6, the grind plate 40 in one embodiment is further formed in the bottom wall thereof, adjacent the medial side, with a generally rounded trapezoidal shaped cutout 44 having edges 47 that taper downwardly and inwardly for receipt of an insert in the form of a trapezoidal shaped plug 45 having its edges also sloped downwardly and inwardly in a wedge to complement the shape of the edges 47 to be retained in such opening 44. The plug 45 may have a coefficient of friction which is different from that of the underside of the plate 40. It will be appreciated that multiple ones of such plugs may be provided with different coefficients of friction so that the athlete can select the particular plug having the particular coefficient of friction which best complements the surface on which the grinding is to take place. With continued reference to FIGS. 5 and 6, the plug 45 is configured with a laterally projecting, downwardly opening, somewhat diamond shaped notch defining a guide track 51 that diverges medially outwardly and upwardly within the body of the plug to provide for critical position of the plate during maneuvering on a rail or the like when the shoe is laid over on the medial side.

The grind plate 40 may further be formed on the proximal side with a generally oval shaped laterally outwardly opening cutout 59 which is also formed with edges 60 which taper laterally outwardly and inwardly toward one another to form a generally wedge shape for receipt of a lateral side guide plate 61 configured with edges complementing the configuration of the edge 60 to be received in plug shaped relationship therein. The insert 61 is formed with an upwardly and laterally outwardly angled somewhat diamond shaped notch 62 which has angular side walls that converge from a relatively wide base upwardly towards an apex near the top of the plate (FIG. 5) so that when the shoe is laid over on the lateral side, such track will provide for precise control of the grind plate on the underlying rail or the like.

The preferred embodiment of the grind plate 40 is designed to be mechanically fastened to the sole 18 for free float at one end to allow free flexing of the sole. To this end, the grind plate 40 is formed on its forward upper side with a pair of upwardly and forwardly projecting, laterally spaced apart slider tines 58 (FIG.1) shaped to be floatably received in the rearwardly opening scoops 122 (FIG. 3) to be retained freely slidable therein. Formed centrally on the upper side at the rear of such plate, is an upwardly projecting annular boss 48 formed in its lower portion with a downwardly opening annular countersink cavity 69 and further configured with a through bore 50 to be aligned with the bore 114 and insert 28 as shown in FIG. 3.

Referring to FIGS. 10 and 1 1, the countersink cavity 69 is formed about its periphery with three radially inwardly projecting somewhat flexible lips 64 spaced downwardly from the top surface of such countersink cavity to cooperate in forming a gland 68. Received rotatably in such gland is a contoured, generally cylindrically shaped, latching washer, generally designated 70, configured with an outer cylindrical stub wall 71 and formed about its perimeter with a downwardly facing annular ring 74. Referring to FIGS. 8 and 9, such ring is formed with a cruciform shaped central opening configured with a transverse release slot 72 for free passage of the transverse keeper pin 38. Such washer is then formed on the diameter perpendicular to the slot 38 with generally V-shaped upwardly recessed keeper dimples 75 configured to complementally receive the keeper pin 38 in the locking position shown in FIGS. 8 and 12. Interposed between the washer 70 and the top wall of the countersink cavity 69, is a compressible 0 ring 67 arranged to bias such annular ring 74 downwardly, as viewed in FIGS. 10 and 11. The locking washer is formed in the area of the peripheral annular ring 74 with a pair of diametrically opposed vertically through bores 79. These bores are spaced to selectively receive the respective tines in a forked release tool (not shown) utilized to release the plate 40.

In operation, it will be appreciated that the liner plate will typically be molded into the shoe sole at the time of manufacture. The shoe will typically be assembled at the plant with a grind plate of the desired general configuration. An athlete may carry with him or her a replacement or alternative grind plate to be carried for installation when a plate is worn or a high performance grinding maneuver is to be undertaken and a different grind plate is better suited the particular grinding surface and maneuver. When an athlete desires to change a grind plate or the like, it will be appreciated that he or she may withdraw the tool from his or her pocket or other secure area and, with the shoe off the foot, access the lock washer 70. The tines of the tool may be inserted into the bores 79 (FIG. 8) and the washer 70 rotated. By rotating the washer, such washer will be forced vertically upwardly by the latch dimples 75 riding upwardly on the top surface of the keeper pin 38 to slightly compress the O ring 67, as shown in FIG. 10. This then allows such washer 70 to be rotated to the position shown in FIG. 9, 90 degrees from the position shown in FIG. 8. This serves to line the transverse release slot 72 with the keeper pin 38 such that the rear extremity of the grind plate 40 may be lowered to the position shown in FIG. 7 disengaging the boss 48 from the bore 114. The tines 58 may then be withdrawn from the respective scoop 122 to release the grind plate. Then, the inserts, 45 and 61, may be replaced with different inserts, either less worn or of a different coefficient of friction for different grinding surfaces, or the entire plate may be replaced as desired.

Referring again to FIG. 7, when the plate is to be inserted, the tines 58 may be slid upwardly and forwardly riding on the upwardly and forwardly sloped bottom walls of the respective scoop 122 to align the boss 48 at the rear thereof under the T-screw 32 so that by pivoting the rear of such plate upwardly the boss 48 will be received within the bore 114 as the lock washer 70 is passed over the keeper pin 38 with such keeper pin being received slidably through the transverse release slot 72 (FIG. 9) to thus nest such boss 48 within the bottom extremity of the bore 114. By further rotating the lock washer 70, as described above, to the position shown in FIG. 8, 90 degrees from the position shown in FIG. 9, the keeper pin 38 will be seated in the keeper dimples 75 (FIG. 12) to be held frictionally in place holding the grind plate 40 locked in position in the cavity 20.

With the grind plate 40 locked in position in the cavity, as shown in FIG. 3, the athlete wearing the shoe can walk, run, jump or grind with a great deal of freedom. As the athlete walks or runs, it will be appreciated that typically the heel section 22 of the shoe strikes the support surface first and the forefoot then rolls downwardly and the rear foot is then raised. In the preferred embodiment, the plate 117, being flexible, will allow a substantial degree of flexibility in the shoe sole 18. The walking flexibility of such sole will be accommodated by a certain degree of relative movement between the front end of the grind plate and the sole 18. As the heel is raised and weight shifted to the forefoot, the rear portion of such sole will be flexed in a slight upward curved arc. Thus, any such upward curving of the rear portion of the sole due to flexing will be accommodated by the relative lost motion between the tines 58 and scoops 122. As will be clear to those skilled in the art, the tines 58 are generally supported on the bottom walls of the respective scoops 122 and are wholly free to float forwardly and rearwardly within the scoop without meaningful frictional resistance. This floatable coupling arrangement minimizes any resistance to such relative movement and, such bottom walls 122, being angled downwardly and rearwardly, and the tines, being angled upwardly and forwardly, provides for cooperation such that the relatively rigid plate can, in effect, pivot relative to the rear extremity thereof with the forward extremity moving downwardly and rearwardly relative to the front extremity of the insole plate 117 and, consequently, the front extremity of the cavity thereby affording freedom of movement. This relatively free longitudinal movement of the respective tines 58 relative to the scoop 122 thus affords free flexing of the sole over the grind plate to thereby provide a natural gait in the step of the wearer.

Referring to FIGS. 1 and 3, the mounting plate 117 is made of lightweight strong plastic and the box type structure of the scoops 122 give them a relatively high strength to weight ratio such that the total weight of the forward fastener elements, including the scoops 122 and tines 58 is minimal thereby affording an extremely lightweight overall construction. Then, with the latching device at the rear of the grind plate 40 being relatively lightweight, the entire shoe apparatus exhibits a relatively lightweight comfortable construction.

While several forms of the present invention have been illustrated and described, it will also be apparent that various modifications may be made without departing from the spirit and scope of the invention. As an example, embodiments are envisioned wherein a single slide tine 58 might be utilized that such tine or tines may be at the forward extremity of the plate 40 as shown or at the rearward extremity. Other embodiments are envisioned where a tine or transverse lip is incorporated projecting laterally across the extremity of the grind plate 40 at either the front or rear extremity thereof for engagement in a laterally projecting ledge or scoop formed in the shoe sole or in a liner like the plate 40 mounted on such shoe sole. Other embodiments are envisioned wherein one or more tines are formed in the shoe sole or in a liner comparable to the liner 117 to project downwardly toward the plate 40 to be received in a scoop or flange formed in such plate.

In a similar fashion, it is envisioned that the lock at the extremity of the plate opposite the tines 58 may take many different forms, it only being important that the plate be allowed to slidably attach to the sole at one end. In one embodiment, the opposite end of such plate is secured by the quick release 32. Such quick release may be in the form shown or may include a fixed locking washer in the plate with the T-screw 32 mounted to the sole being rotatable. In some embodiments, the T-screw takes the form of a pin that is embedded directly in the body of the shoe sole 18 in fixed relationship as shown, and in other embodiments, it is suspended from an anchor washer mounted at the top end thereof and embedded in the sole itself. In some embodiments, the lock device is in the form of a stem carried from the sole to project through a bore in the grind plate and is configured with a toggle lock which mounts on its lower end a keeper responsive to a toggle latch to be displaced relative to the stem upon rotation of the toggle to lock the end of the plate to the shoe sole. In other embodiments, the lock is in the form of a screw carried from the plate and having a laterally projecting keeper at the top end for receipt in a socket formed in the sole or an insert mounted in such sole. It is envisioned that those skilled in the art would readily employ any of the foregoing locks or equivalent locks in carrying into practice the quick release grind shoe apparatus of the present invention.

From the foregoing, it will be apparent that the grind shoe apparatus incorporating a quick release grind plate of the present invention provides a unique configuration allowing for the quick removal and replacement of a grind plate from a grinding shoe when the grinding surface or wear and tear call for replacement. The present invention provides the athlete with the freedom to is or her grinding equipment to the idiosyncracies of various grinding surfaces, and a reliable of securement to ensure the athlete does not sacrifice safety when making these adaptations.

Various modifications and changes may be made with regard to the foregoing detailed description without departing from the spirit of the invention.

What is claimed is:

1. A grind shoe comprising:

a shoe having a sole formed on its bottom side with a downwardly opening cavity;

a first slide fastener device mounted in said sole at one extremity of said cavity, said first slide fastener device includes a female scoop having a bottom wall angling downwardly and rearwardly, said scoop opening rearwardly into said cavity;

a first lock device mounted at a second extremity of said cavity opposite said one extremity;

an elongated grind plate configured on its top side to be received complementally in said cavity and including at one extremity a second slide fastener in the form of a tine configured to be cooperatively received in floating engagement with said first slide fastener device for free longitudinal movement relative thereto; and a second lock device on a rear extremity of said grind plate opposite said one extremity of said grind plate for releasably engaging said first lock device.

2. A grinding shoe as set forth in claim 1 wherein:

said first slide fastener device includes a pair of female scoops opening rearwardly into said cavity; and said grind plate is formed with said second slide fastener configured with a pair of laterally spaced apart tines received slidably in respective said scoops for free longitudinal movement relative to thereto.

3. A grinding shoe comprising:

a shoe having a sole formed on its bottom side with a downwardly opening cavity;

a first slide fastener device in said sole at the front extremity of said cavity;

a first lock device mounted to said sole at the rear of said cavity and including a downwardly projecting stem formed with a laterally projecting keeper shiftable from a locked position to an unlocked position;

an elongated grind plate configured to be received in said cavity and including at its front extremity a second slide fastener to cooperate with said first slide fastener to, upon sliding of said plate forwardly into position in said cavity, fasten said front extremity of said plate upwardly in position in said cavity; and a second lock device on the rear extremity of said grind plate and formed with a stem passage for receipt of said stem and said keeper and formed with a lock plate configured to be, when said stem is in said latching position, disposed in the path of said keeper to cooperate in locking said grind plate in position in said cavity.

4. The grinding shoe as set forth in claim 3 wherein:

said sole is formed at the front extremity of said cavity with a pair of laterally disposed, rearwardly opening, longitudinal fastener passages defining said first slide fastener; and said grind plate is formed at its front extremity with a pair of laterally spaced, forwardly projecting tines configured for slidable receipt in the respective said passages to define said second slide fastener.

5. The grinding shoe as set forth in claim 3 that includes:

said sole includes a hard liner formed with a scoop lining said passage.

6. The grinding shoe of claim 3 wherein:

said first lock device is configured with said stem being rotatable and is formed with said keeper projecting laterally therefrom; and said second lock device is formed with said lock plate configured for passage therethrough of said keeper when said lock is in said unlocked position.

7. The grinding shoe of claim 3 wherein:

said grind plate is formed rearwardly with a through bore having at its bottom extremity a downwardly opening countersink cavity configured with a downwardly facing annular shoulder;

said second lock device includes a washer nested in said cavity and formed with an opening defining said stem passage and is further formed with a laterally projecting slot disposed on a first diameter and a downwardly facing keeper detent formed on a laterally projecting diameter; and said stem is rotatable and includes a laterally projecting cross pin defining said keeper for selectively passing through said slot and for nesting in said detents upon rotation of said stem.

8. The grinding shoe as set forth in claim 7 that includes:

a compressible tensioning ring interposed between said shoulder and latch washer.

9. A grinding shoe comprising:

a shoe having a sole formed on its bottom side with a downwardly opening cavity;

a first slide fastener device in said sole at the front extremity of said cavity;

a first lock device mounted to said sole at the rear of said cavity and including a downwardly projecting fixedly mounted stem formed with a laterally projecting keeper;

an elongated grind plate configured to be received in said cavity and including at its front extremity a second slide fastener to cooperate with said first slide fastener to, upon sliding of said plate forwardly into position in said cavity, fasten said front extremity of said plate upwardly in position in said cavity; and a second lock device on the rear extremity of said grind plate having a rotatable locking plate shiftable from a locked to an unlocked position, said locking plate being formed with a stem passage for receipt of said stem and said keeper and configured to be, when said lock plate is in said locked position, disposed in the path of said keeper to cooperate in locking said grind plate in position in said cavity.

10. The grinding shoe as set forth in claim 9 wherein:

said sole is formed at the front extremity of said cavity with a pair of laterally disposed, rearwardly opening, longitudinal fastener passages defining said first slide fastener; and said grind plate is formed at its front extremity with a pair of laterally spaced, forwardly projecting tines configured for slidable receipt in the respective said passages to define said second slide fastener.

11. The grinding shoe as set forth in claim 10 wherein:

said sole includes a hard liner lining said passages.

12. The grinding shoe as set forth in claim 9 wherein:

said grind plate is formed at its rear extremity with a downwardly opening bore and is configured at the top end of said bore with a reduced in diameter lock rim configured with a downwardly facing annular shoulder;

said first lock device is fixably mounted to said sole at the rear of said cavity and includes a downwardly projecting stem formed with a laterally projecting keeper;

said second lock device includes a washer rotatably nested in said bore against said rim and formed with an opening defining said stem passage, and is further formed with a laterally projecting slot disposed on a first diameter and a downwardly facing keeper detent formed on a laterally projecting diameter, said washer being rotatable from a locked to an unlocked position; and said stem includes a laterally projecting cross pin defining said keeper for selectively passing through said slot when said washer is in said unlocked position and for nesting in said detents upon rotation of said washer to said locked position.

13. The grinding shoe as set forth in claim 12 that includes:

a compressible tensioning ring interposed between said rim and latch washer.

14. The grinding shoe as set forth in claim 7 for use with a locking tool to be used for securing said grind plate to said sole and wherein:

said first lock device is configured to rotatably mount said stem for rotation between said locked and unlocked position; and said stem includes on the lower end thereof a tool engagement head.

15. The grinding shoe as set forth in claim 14 or use with a locking tool to be used for securing said grind plate to said sole and wherein:

said washer includes a tool engagement head; and said locking tool is engageable with said head for rotating said stem.

16. The grinding shoe as set forth in claim 3 that includes:

a liner plate positioned on top of said sole and formed at its forward extremity with a downwardly depending scoop opening rearwardly into said cavity for slidable receipt of said second slide fastener.

17. The grinding shoe as set forth in claim 3 wherein:

said first lock device includes an internally threaded tubular insert embedded in said sole; and said first lock device is configured with said stem formed with a threaded shank for rotatable receipt in said insert.

18. A grind plate device to be received upwardly into a cavity formed in the sole of a grinding shoe and having a fastener passage opening rearwardly into such cavity from the front thereof and a positioning socket formed rearwardly in said cavity, said plate device comprising:

a grind plate body formed on its top side to be complementally received in said cavity and being formed rearwardly with an upwardly projecting positioning boss assembly to be nested in said socket to cooperate in holding said plate in position in said cavity;

a forwardly projecting fastener tine at the front of said plate to be slidable received in said fastener passage to be held therein; and a quick release lock assembly for cooperating between said plate and said sole to releasably lock said plate in said cavity with said positioning boss assembly nested in said socket.

19. The grind plate device as set forth in claim 18 for use with a sole that is formed at the front extremity with said fastener passage and wherein:

said fastener passage is in the form of a rearwardly opening cutout for complemental receipt of said tine.

20. The grind plate device as set forth in claim 18 wherein:

said cavity includes a hard liner lining said rearwardly opening fastener passage and including a downwardly projecting scoop projecting into said positioning socket.

21. The grind plate device as set forth in claim 18 wherein:

said grind plate body is formed with said boss configured with a downwardly opening nesting bore and is formed in its upper portion with a reduced-in-diameter lock rim formed with a downwardly facing annular shoulder; and said quick release lock assembly includes an annular lock washer nested in said downwardly opening bore and formed with a diametrically projecting passage slot.

22. The grind plate device as set forth in claim 18 wherein:

said grind plate body is formed with a pair of forwardly projecting, laterally spaced apart tines.

23. The grind plate device as set forth in claim 18 wherein:

said grind plate body is configured with a bottom surface turned upwardly and outwardly in the lateral opposite directions and is further formed on its opposite sides with through holes having engagement rails projecting radially inwardly from the edges of such holes; and said grind plate body includes inserts removably received in said through holes from the top side of said grind plate and configured with respective laterally projecting guide tracks for selectively engaging the rails.

24. The grind plate device as set forth in claim 18 wherein:

said tine is formed to be slidably received in said fastener passage to provide lost motion between said passage and said tine as said sole is flexed.

25. A grind shoe apparatus for assembly to a grind shoe sole configured on its bottom side with a downwardly opening cavity of a predetermined shape and having at the rear extremity of said cavity a through bore and at the forward extremity of said cavity at least one through opening, said apparatus comprising:

a liner frame to be positioned on said sole and configured with a downwardly depending liner frame lock boss removably received in said bore and formed in its forward extremity with a downwardly projecting receiver defining a receiver passage opening rearwardly into said cavity; and a grind plate body configured on its top side to be complementally received in said cavity and formed at its forward extremity with at least one upwardly and forwardly projecting tine to be received in said receiver and further being formed at its rear extremity with an upwardly projecting grind plate lock boss for receipt in said bore; and a lock assembly releasably connecting said liner plate lock boss and said grind plate lock boss together.

26. The grind shoe apparatus set forth in claim 25 wherein:

said shoe is formed at the forward extremity of said cavity with a pair of through openings;

said liner frame is formed with a pair of downwardly depending scoops disposed in said respective said openings and formed with rearwardly opening receiver passages; and said grind plate body includes a pair of upwardly and forwardly projecting tines slidably received in said receiver passages.

27. The grind shoe apparatus as set forth in claim 26 wherein:

said lock assembly includes a rotary stem and a keeper configured and arranged so that a quarter turn of said stem will release said keeper to release the rear extremity of said plate from said liner frame.

* * * * *